United States Patent [19]

Verdickt

[11] 4,375,160

[45] Mar. 1, 1983

[54] MANUFACTURE OF SEAMLESS STEEL TUBE

[75] Inventor: Jacques Verdickt, Paris, France

[73] Assignee: Vallourec, Paris, France

[21] Appl. No.: 208,448

[22] Filed: Nov. 19, 1980

[30] Foreign Application Priority Data

Nov. 21, 1979 [FR] France ..... 79 28700

[51] Int. Cl.[3] ..... B21B 17/10; B21B 31/20

[52] U.S. Cl. ..... 72/208; 72/366; 72/370

[58] Field of Search ..... 72/208, 209, 365, 366, 72/368, 370

[56] References Cited

U.S. PATENT DOCUMENTS 3,857,267 12/1974 Lemaire et al. ..... 72/209

*Primary Examiner*—Francis S. Husar
*Assistant Examiner*—Jonathan L. Scherer
*Attorney, Agent, or Firm*—Pollock, Vande Sande & Priddy

[57] ABSTRACT

In the manufacture of seamless steel tube by hot-rolling a tube blank on a mandrel in a continuous rolling mill, the tube is withdrawn from the mandrel and reduced by reducing roll stands downstream of and in alignment with the rolling mill which operate on the part of the tube withdrawn from the mandrel. The mandrel is advanced through the rolling mill at a controlled speed and is not released until the reduction of the tube has been completed. The reducing roll stands are then opened and the released mandrel follows the tube through the stands but without contacting the rolls.

3 Claims, 5 Drawing Figures

MANUFACTURE OF SEAMLESS STEEL TUBE

The invention relates to the manufacture of a seamless steel tube by hot rolling on a mandrel.

In certain processes for hot rolling, on a long mandrel, of tubular blanks by means of a continuous rolling mill or the like, in which processes the mandrel is held during the rolling, it has proved possible to locate, downstream from the rolling mill and along the same pass axis, one or more so-called "extraction" stands, in which the tube is gripped towards the end of the rolling operation, which has the effect of withdrawing the tube from the mandrel while the latter continues to be held upstream of the rolling mill.

Though in this type of installation the mandrel is then withdrawn upstream of the rolling mill in order to start the next blank on the mandrel as soon as the blank which has just been rolled is disengaged, this does not exclude breakage of the mandrel or of the gripping device, which has the effect that a portion of tube still on the mandrel passes through the extraction stands. It is to be noted that, in order to generate a sufficient extraction force, the extraction stands must exert a radial force which is such that it normally results in a slight reduction of the diameter of the tube, the thickness of which has not changed. However, if a part of the tube presents itself with the mandrel still inside it, the extraction rollers, which no longer act on a hollow tube, have to exert such considerable forces that breakage results. There are well-known safety devices in rolling mills which allow the rollers of the extraction stands to retract when the forces become excessive, but experience shows that, in view of the speeds of travel of the product, and the weights involved, these devices only function appropriately if the opening to be produced is slight and quite compatible with the slight reductions in diameters required to assure extraction.

In view of the above, it has always been considered industrially impossible to effect substantial reductions in diameter on the actual extractor; if the rolled tube must be subjected to a substantial reduction in diameter, this can thus only be carried out on a reducer which is sufficiently far from the rolling mill/extractor assembly that the rolled tubes which might still contain all or part of a mandrel can be stopped and taken out of the line. Thhe distances and times required for this possible checking and sorting operation are such that, for tubes rolled under normal conditions, the temperature is no longer sufficiently high when they arrive at the reducer. Thus, the rolled tubes are systematically reheated before reduction, resulting in a substantial waste of energy.

In other processes (continuous rolling mill) using a free mandrel or a controlled-speed mandrel, with release of the mandrel at the end of the rolling operation, it is known to extract the mandrel from the rolled tube away from the pass axis of the rolling mill, the mandrel being passed to the cooling and recycling devices while the rolled tube is passed to a reducer rolling mill.

However, the succession of these operations (braking and stopping the tube on the mandrel, transfer into a position along the axis of the mandrel remover, and removal of the mandrel) is such that the blank cools and can no longer undergo a reduction in diameter without prior reheating, resulting in a considerable loss of energy.

The invention relates to a process for the manufacture of a weldless steel tube, in which a tube blank pushed onto a mandrel is hot-rolled in a continuous rolling mill, the mandrel is caused to travel at a controlled speed during rolling, the tube is removed from the mandrel and the mandrel is released at the end of the rolling operation so that it issues from the continuous rolling mill after the tube. The invention is intended to avoid the abovementioned disadvantages.

The process of the invention is characterized in that a reduction of the tube is started along the axis of the rolling mill, in the zone of the tube where there is no longer a mandrel, before the end of the rolling of the tube, by passing this zone of the tube between reduction rolls located downstream and in line with the continuous rolling mill, in that the reduction of the tube, and at the same time its removal from the mandrel, are completed before releasing the mandrel, and before the mandrel which follows the tube presents itself before the reducing roll stands, and in that the opening of the said stands is triggered before passing the mandrel through the reducing roll stands, so as to avoid any contact between the mandrel and the working surfaces of the reducing rolls.

This process makes it possible to obtain, on a hollow tube, substantial reductions in the diameter and, if desired, in the thickness of the tube, the last-mentioned being made possible by the actual magnitude of the diameter reduction, the said reductions being achievable along the pass axis of the continuous rolling mill, at a very short distance from the rolling mill and without any handling of the product, so that the time which elapses between the passage of a particular length of product through the rolling mill and its passage through the reducer is very short and does not require intermediate reheating. This in turn achieves a substantial saving of energy and a great simplification of the installation, so that the investment cost of the installation, as well as the cost of its operation and maintenance, are very substantially reduced.

The mandrel is then passed to the circuits for cooling, checking if required, and recycling to the inlet of the rolling mill.

A device for carrying out the process comprises a continuous rolling mill, means for escorting the mandrel at a controlled speed during the rolling of the blank, reducing roll stands downstream of the continuous rolling mill and in line therewith, means for supporting the mandrel during its travel through the reducing roll stands, without the mandrel making contact with the rolls, and means for causing the opening of the reducing rolls before the mandrel passes through them.

This device can be considered as the combination of a continuous rolling mill, which acts on a long mandrel which has a controlled speed during rolling and is released at the end of the rolling operation, with a particular reducer sinking mill.

An illustrated embodiment of the invention will be described below with reference to the figures of the attached drawing, in which.

Figure 1:
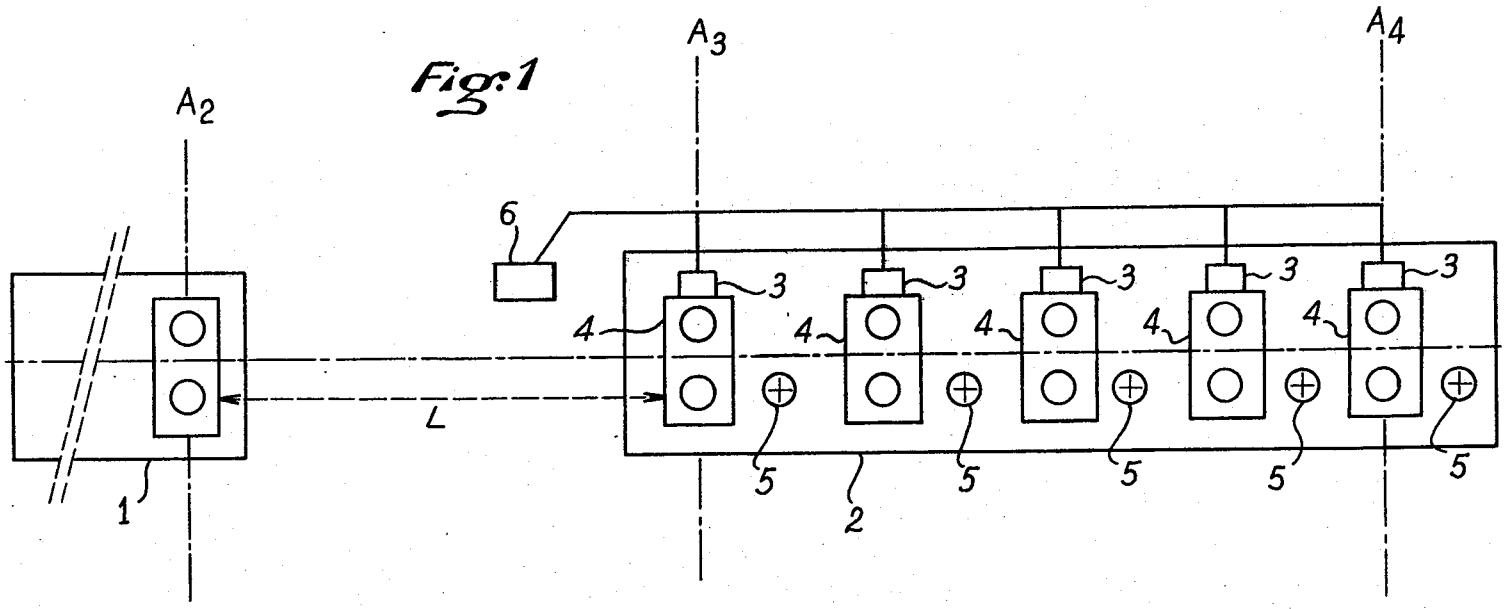
FIG. 1 is a diagram of an installation according to the invention.

The figures relate to rolling on a long mandrel, and reduction at one heat, i.e., without intermediate reheating, of a thin tube obtained in a reproducible process with controlled holding-back of the mandrel.

By a "thin" tube is meant a tube within the range of 100×4 (mm) to 250×7 (mm), the first and the second figures respectively denoting the external diameter and the wall thickness of the tube.

By substantial reduction there is meant values of the ratio of entry diameter/exit diameter of up to 3 or even more.

The installation essentially comprises (FIG. 1) a continuous rolling mill 1 and a reducer-extractor rolling mill 2 (for reducing the tube and separating it from the mandrel) in line with the continuous rolling mill. The distance L between the last stand of the continuous rolling mill and the first stand of the reducer-extractor rolling mill is as small as possible and is of the order of one length of tube, namely, for example a distance of the order of 10 meters.

The two rolling mills are synchronized in speed, the output speed of the continuous rolling mill being, for example, 2 to 5 m/s, so that the interval of time between rolling and reduction is generally less than one minute.

The numbers of roll stands of the rolling mills are chosen in accordance with requirements, in a manner known per se.

The continuous rolling mill and the reducer-rolling mill are known to those skilled in the art, and hence only the modifications made by the present invention to the reducer rolling mill, in order to carry out the new process, will be described.

The modifications comprise:

control devices 3 for completely and rapidly moving the rolls of the reducing roll stands apart, to give a passage cross-section between the rolls which is markedly greater than the diameter of the mandrel;

mechanical devices 5 for supporting the mandrel, which are located between the reducing roll stands and are able to come into position around, or simply below, the pass axis, so as to hold the mandrel there during its passage, so that the mandrel cannot at any time come into contact with the reduction rollers in the open position, as such contact would cause a deterioration of the working surfaces of the mandrel and of the rollers, rapidly rendering them unsuitable for correct rolling;

devices 6 for detecting the arrival of the tube and of the mandrel in front of the reducer rolling mill 2, which devices, at the appropriate time, cause the mechanisms 3 to open the housings 4 to the required size; and regulating devices for regulating the speed of the rolls of the reducer rolling mill in precise relation to the speed of the rolls of the continuous rolling mill, thereby avoiding any fault in the product which might result from an inadequate difference in speed between the continuous rolling mill and the reducer rolling mill when the rolling mills are simultaneously in engagement on the tube.

It is not necessary to describe in detail these devices, which are known per se. However, by way of examples, two embodiments of a roll stand of the reducer-extractor rolling mill will be described below with reference to FIGS. 2 and 3.

Figure 2:
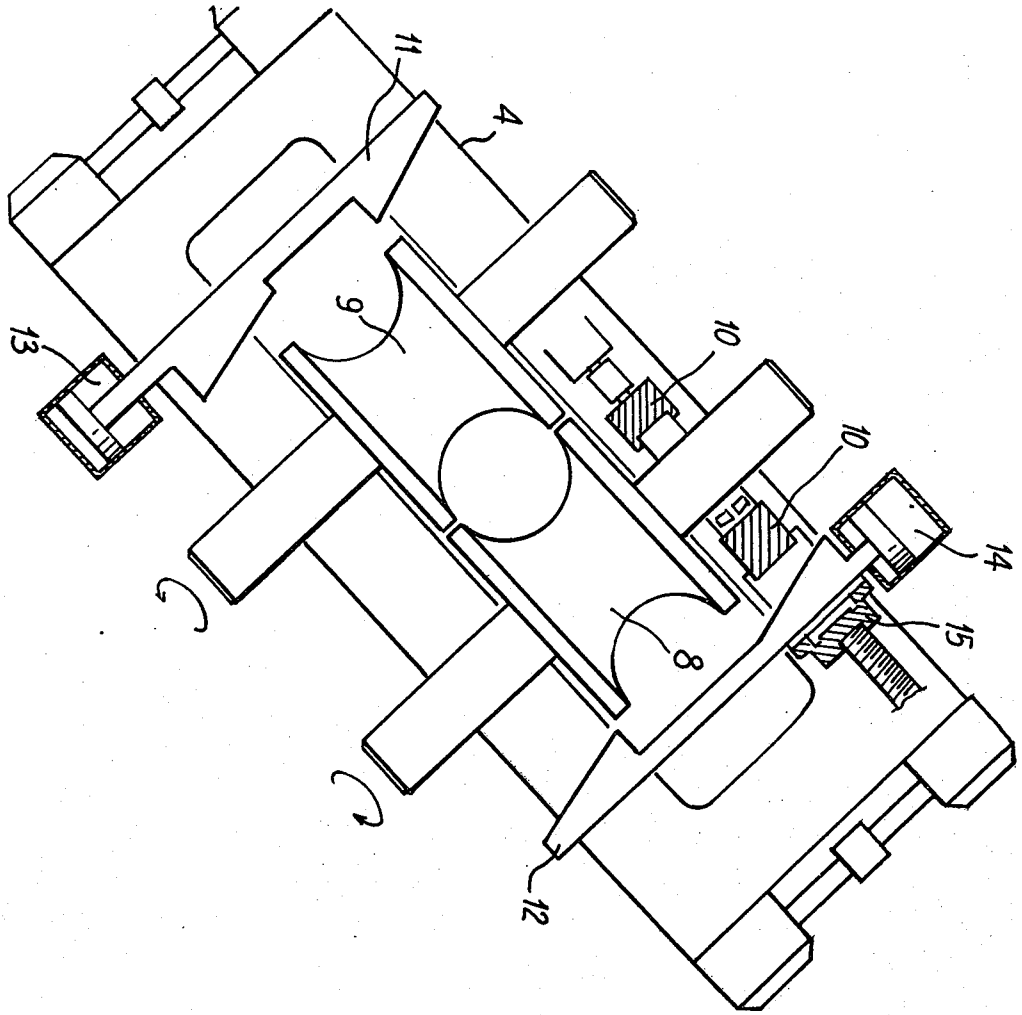
FIG. 2 and FIG. 3 are diagrammatic cross-sections of two embodiments of a roll stand of the exterior rolling mill.
Figure 3:
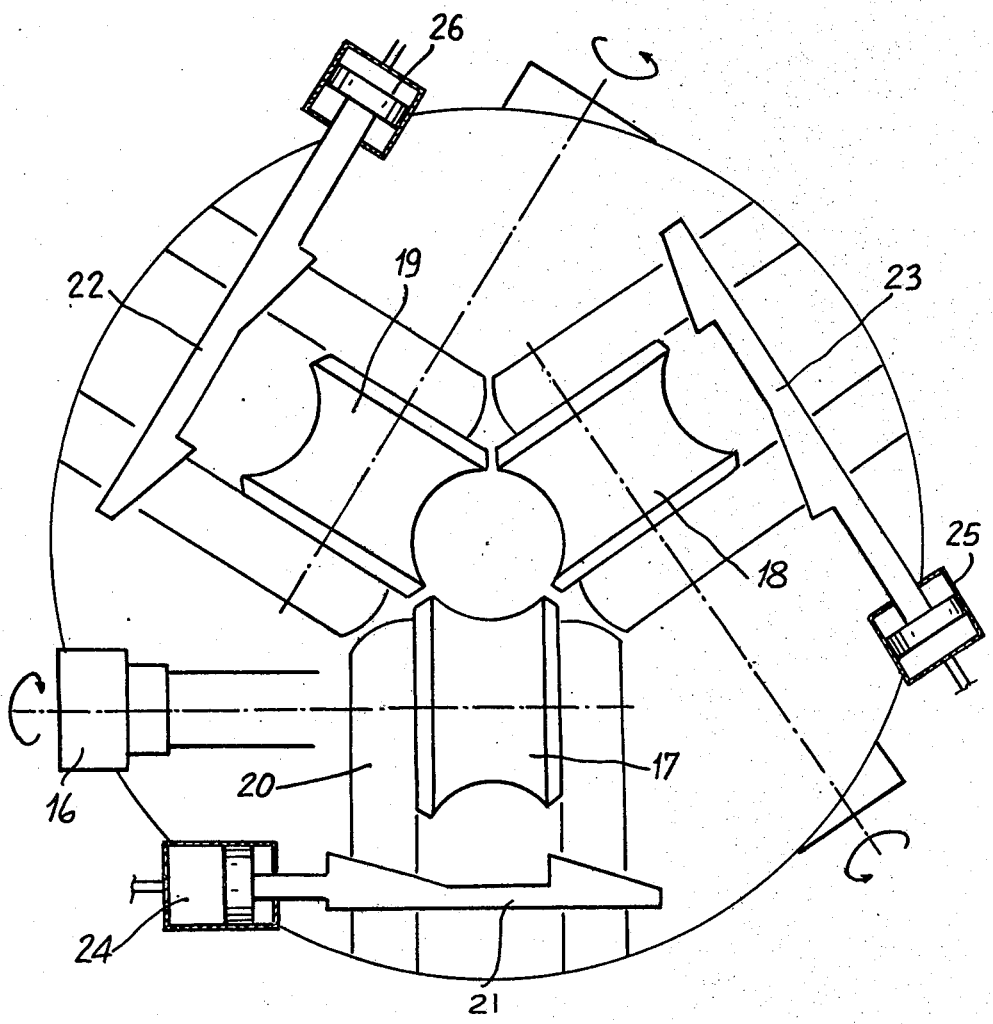

FIGS. 2 and 3 show different embodiments of a roll stand of the extractor rolling mill.

FIG. 2 illustrates a stand 4 of the type with two rollers 8 and 9. The four chocks 10 slide in slots machined in the housing.

A double wedge 11 and a similar member 12, respectively for the upper and lower parts of the housing, make it possible to bring the rollers 8 and 9 together, or move them apart, under the action of jacks 13 and 14. The close position corresponds to the reduction and to the subsequent removal from the mandrel, while the open position corresponds to the passage of the mandrel through the extract or rolling mill.

In a case where the mandrel has been "swallowed", the abnormal force causes a rise in pressure in the jacks 13 and 14 and a discharge valve opens. For double safety, breakable boxes 15 are interposed between the tightening screws 16 and the contact face.

FIG. 3 shows a stand 4 of the type with three rolls 17, 18 and 19.

The bearings of the rollers are located in the sliding chocks 20.

Three sloping double wedges 21, 22 and 23 make it possible respectively to bring the rollers 17, 18 and 19 towards one another or to move them apart.

The close position corresponds to the operation of reduction and subsequent removal from the mandrel, while the open position corresponds to the passage of the mandrel through an extractor rolling mill.

Three jacks 24, 25 and 26 provide the movements in question.

In a case where the mandrel has been swallowed, the abnormal force causes a rise in pressure in the jacks and a discharge valve opens.

It will be noted that the rolls open automatically if the head-end of the mandrel accidentally passes beyond a certain position.

Figure 4:
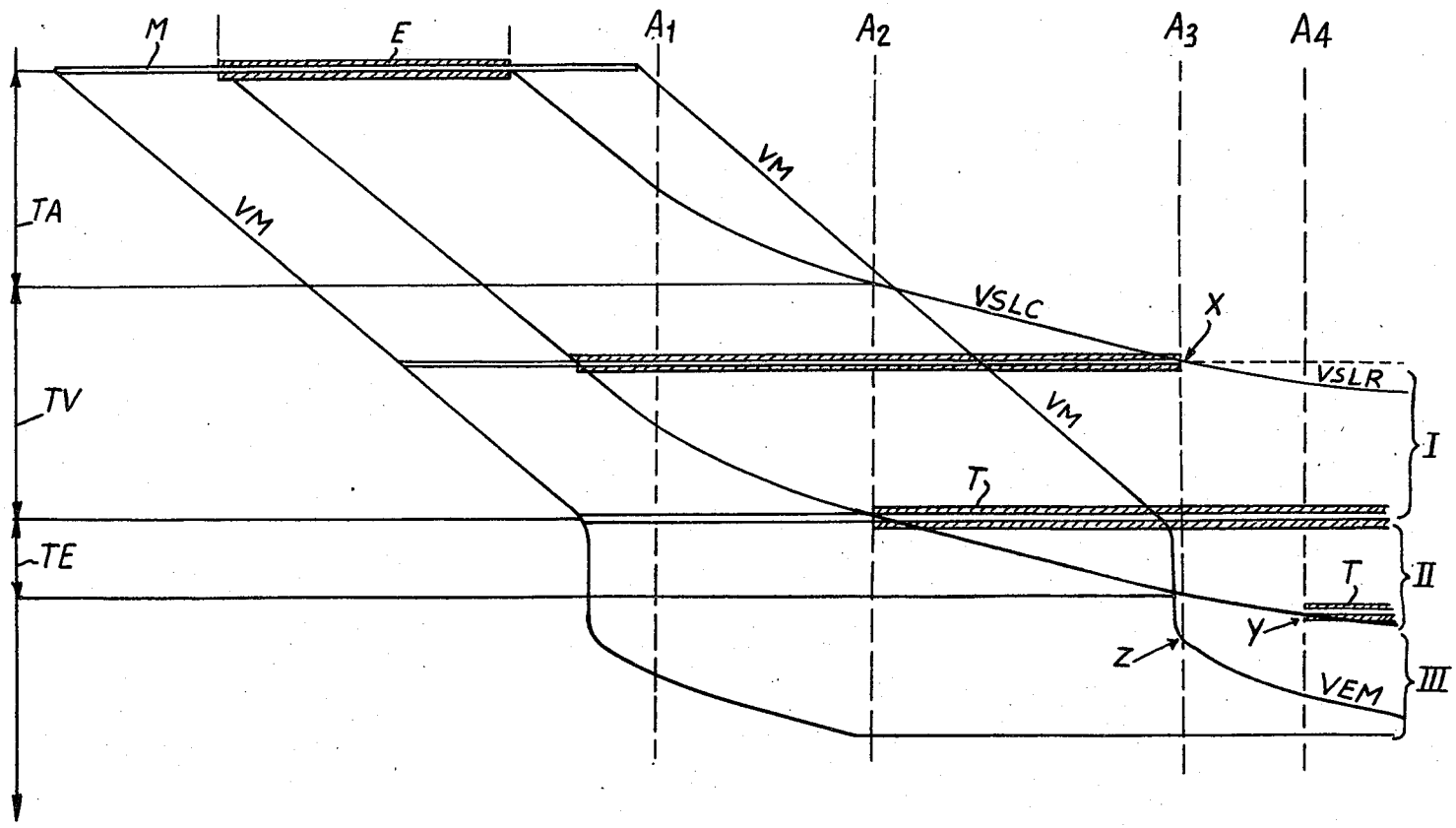
FIG. 4 is a space-time diagram of the speeds of the tube and of the mandrel in the installation, and FIG. 5 schematically shows the roll stands of the reducing mill during the various stages of the process.

The graph in FIG. 4 makes it possible to compare the relative movements of the mandrel and of the blank E (which will become the tube T) during rolling and during the subsequent reduction of the tube.

For all the details concerning the rolling of the blank in the continuous rolling mill, reference may be made to French Pat. No. 72 31888, issued on an application filed on Sept 8, 1972, which describes a process for the manufacture of a weldless metallic tube on a mandrel in a continuous rolling mill. In this process, as in the present case, the mandrel M is initially held back so as to travel at a controlled speed, for example at constant speed, and is subsequently released, when the rolling operation is completed, so that it issues from the continuous rolling mill after the blank which has become the tube T.

In FIG. 4, the references have the following meanings:

A1: Position of the first stand of the continuous rolling mill

A2: Position of the last stand of the continuous rolling mill

A3: Position of the first stand of the reducer-extractor

A4: Position of the last stand of the reducer-extractor

TA: Duration of approach and of filling the continuous rolling mill

TV: Duration of issue of the tube from the continuous rolling mill

TE: Duration of extraction of the mandrel from the tube

VM: Speed of the mandrel during the rolling

VSLC: Speed of issue of the tube from the continuous rolling mill

VSLR: Speed of issue of the tube from the reducer-extractor rolling mill

VEM: Speed of discharge of the mandrel.

It can be seen in the figure that:

(a) the mandrel is caused to travel at a controlled speed (in the present case a constant speed), VM, during rolling;

(b) the reduction of the blank of the tube is started before the end of the rolling (point X);

(c) the reduction of the tube (point Y) is completed before releasing the mandrel (point Z).

Figure 5:
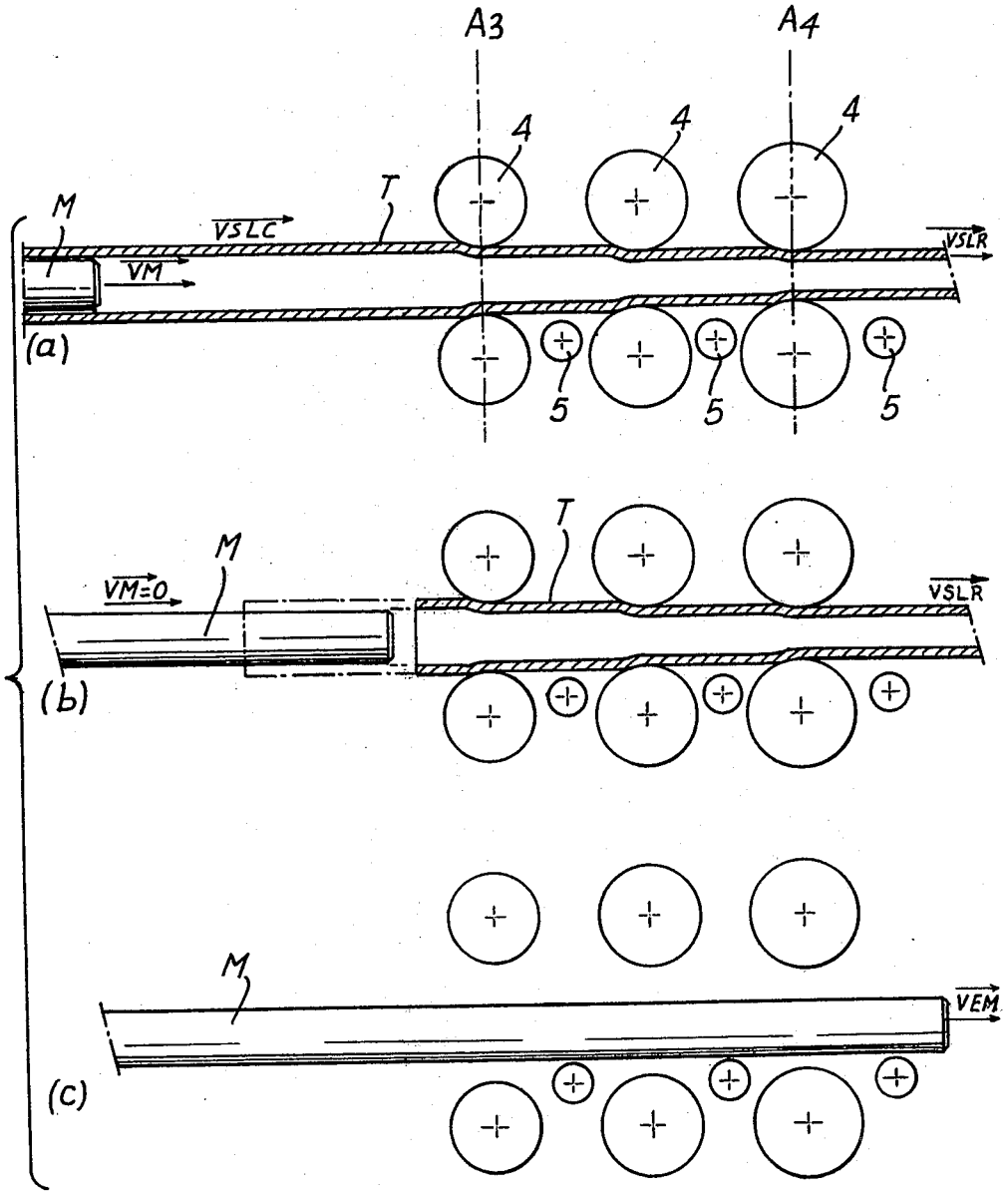

FIG. 5 shows diagrams (a), (b) and (c) of the relative arrangements of the rollers of the stands of the reducer-extractor rolling mill (there are assumed to be three stands), of the tube T and of the mandrel M, respectively during the stages I, II and III of FIG. 4:

diagram (a): rolling of the blank on the mandrel and, simultaneously, reduction of the tube, diagram (b): extraction and reduction of the tube, diagram (c): passage of the mandrel through the reducer-extractor rolling mill.

The extractor rolling mill preferably possesses a large number of stands, for example at least five stands, as shown in FIG. 1. In FIG. 5, only the two end stands and the central stands of the rolling mill have been shown, for convenience of illustration, but it will be understood that a rolling mill with five stands, as in the case of FIG. 1, is involved.

I claim:

1. A process for the manufacture of a seamless steel tube comprising the steps of hot-rolling a tube blank sleeved on a mandrel in a continuous rolling mill, controlling the speed of the mandrel during said rolling, withdrawing the tube from the mandrel and releasing the mandrel at the end of the rolling operation so that it issues from the continuous rolling mill after the tube, commencing reduction of the tube along the axis of the rolling mill, in the zone of the tube not filled by the mandrel, before the end of the rolling operation, by passing the said zone between reducing rolls located downstream of and in line with the continuous rolling mill, completing the reduction of the tube before releasing the mandrel and before the mandrel, following the tube, reaches the reducing roll stands, and triggering the opening of the reducing roll stands before the mandrel is passed through the said reducing stands, whereby contact of the mandrel with the working surfaces of the reducing rolls is avoided.

2. A process as claimed in claim 1 wherein the reducing roll stands are opened before the mandrel is released.

3. Apparatus for the manufacture of a seamless steel tube comprising a continuous rolling mill, a mandrel, means for controlling the speed of travel of the mandrel through the rolling mill during the rolling of a tube blank, reducing roll stands downstream of the rolling mill and in line therewith, means for supporting the mandrel during its travel through the reducing roll stands without contact with the reducing rolls, and means for effecting opening of the reducing roll stands before the mandrel passes through them.

* * * * *